US005085156A

United States Patent [19]

Dykema

[11] Patent Number: 5,085,156

[45] Date of Patent: Feb. 4, 1992

[54] COMBUSTION PROCESS

[75] Inventor: Owen W. Dykema, Canoga Park, Calif.

[73] Assignee: TransAlta Resources Investment Corporation, Calgary, Canada

[21] Appl. No.: 461,939

[22] Filed: Jan. 8, 1990

[51] Int. Cl.[5] ..... F23D 1/00

[52] U.S. Cl. ..... 110/347; 110/263; 432/72; 431/3; 431/10

[58] Field of Search ..... 110/211, 214, 347, 263; 432/72; 431/3, 10

[56] References Cited

U.S. PATENT DOCUMENTS

| | | | |
|---|---|---|---|
| 4,427,362 | 1/1984 | Dykema . | |
| 4,475,472 | 10/1984 | Adrian et al. | 110/211 |
| 4,500,281 | 2/1985 | Beardmore . | |
| 4,504,211 | 3/1985 | Beardmore . | |
| 4,523,532 | 6/1985 | Moriarty . | |
| 4,779,545 | 10/1988 | Breen et al. | 110/214 |
| 4,951,579 | 8/1990 | Bell | 110/214 |

FOREIGN PATENT DOCUMENTS

| | | |
|---|---|---|
| 0184846 | 6/1986 | European Pat. Off. . |
| WO8906334 | 7/1989 | PCT Int'l Appl. . |
| 1508459 | 4/1978 | United Kingdom . |
| 2009375 | 6/1979 | United Kingdom . |
| 2077135 | 12/1981 | United Kingdom . |
| 2196984 | 5/1988 | United Kingdom . |

OTHER PUBLICATIONS

Laine, Jouko; A Method of Combustion for the Reduction of the Formation of Nitrogen Oxides in a Combustion Process, and an Apparatus for Applying the Method; 7/13/89.

*Primary Examiner*—Henry C. Yuen

*Attorney, Agent, or Firm*—Fitzpatrick, Cella, Harper & Scinto

[57] ABSTRACT

A combustion process for nitrogen- or for sulphur- and nitrogen-bearing fuels wherein fuel combustion is divided, by staged oxygen (preferably in the form of air) injection, into at least two combustion zones. The first combustion zone involves providing fuel-rich stoichiometric conditions under which nitrogen chemically bound in the fuel (i.e. fuel-bound nitrogen) is substantially converted to molecular nitrogen. The second (final) combustion zone comprises at least two stages. In the first stage of the final combustion zone, combustion products from the first combustion zone are further conbusted under a condition of fuel-rich stoichiometry, preferably at an oxygen/fuel stoichiometric ratio of from about 0.08 to about 1.0 and at a temperature of less than about 2200 K. In the second stage of the final combustion zone, combustion products from the first stage are combusted at an oxygen/fuel stoichiometric ratio of greater than about 1.0 and at a temperature of less than about 1500 K. In this final zone, fuel combustion is completed while formation of new thermal $NO_x$ is substantially prevented. Thus, the process may be used to reduce emissions of undesirable nitrogenous compounds (e.g. $NO_x$) which would ordinarily be formed during completion of fuel combustion. The process is particularly appropriate for use with the fuel-rich gases from a burner designed to control air pollutants arising from sulphur and nitrogen in the fuel.

13 Claims, 1 Drawing Sheet

COMBUSTION PROCESS

FIELD OF THE INVENTION

The present invention relates to a process for the combustion of a nitrogen-bearing or a sulphur- and nitrogen-bearing fuel. More particularly, the present invention relates to a combustion process for such a fuel whereby the emission of undesirable gaseous nitrogenous compounds (e.g. $NO_x$) is minimized.

BRIEF DESCRIPTION OF THE PRIOR ART

It is known that during conventional combustion of fossil fuels, the nitrogen and sulphur chemically bound in those fuels can be oxidized to $NO_x$ and $SO_x$, respectively. In addition, $NO_x$ can be formed by high temperature oxidation of nitrogen in the combustion air. $NO_x$ derived from the first of these mechanisms (i.e. from fuel-bound nitrogen) is referred to as "fuel $NO_x$" while that derived from the second of these mechanisms (i.e. from nitrogen in the combustion air) is referred to as "thermal $NO_x$". A great deal effort in the prior art has been devoted to addressing prevention of the formation of fuel $NO_x$ during combustion of fossil fuels in excess air. If these acid gases, $NO_x$ and $SO_x$, are released to the atmosphere, they can be absorbed in atmospheric moisture and thereafter precipitate to earth as acid rain.

U.S. Pat. Nos. 4,427,362 (Dykema) and 4,523,532 (Moriarty et al), the contents of both of which are incorporated herein by reference, teach a combustion process for substantially reducing emissions of fuel $NO_x$ and of combined fuel $NO_x$ and $SO_x$, respectively, during combustion. Both of these patents teach a combustion process wherein particular oxygen/fuel stoichiometric ratios and temperatures are provided to facilitate conversion of substantially all fuel-bound nitrogen to harmless molecular nitrogen ($N_2$). Moreover, Moriarty et al teach an additional (first) combustion zone to provide control of $SO_x$ emissions in addition to the control of fuel $NO_x$ emissions taught by Dykema. Typically, these air pollutants are simultaneously controlled during combustion in a burner called the low $NO_x/SO_x$ burner.

Thus, both Dykema and Moriarty et al teach combustion processing which result in very low levels of fuel $NO_x$ leaving the low $NO_x/SO_x$ burner. However, the low $NO_x/SO_x$ burner is not designed to fully complete carbon and hydrogen combustion within the burner, but rather only to the level necessary to provide the desired air pollution control. As a result, combustion products leaving the burner and, thereafter, typically entering a boiler, are still the products of fuel-rich combustion. The gases contain high concentrations of carbon monoxide and hydrogen, and the entrained particulate still contains some unburned carbon. All of these fuel constituents must be oxidized, to their lowest energy state, to maximize heat release.

Therefore, at least one subsequent combustion zone, involving high temperatures and/or excess air, is required to complete hydrocarbon combustion. Both Dykema and Moriarty et al teach injecting all of the remaining excess air immediately at the end of the process (i.e. at the exit of the low $NO_x/SO_x$ burner). This results in a combination of both high temperatures and excess air in the final combustion zone. The combustible gases and solids can be conveniently burned to completion in this zone. However, there also exists the likelihood that appreciable concentrations of thermal $NO_x$ may be generated in this final combustion zone.

Thus, it appears that the prior art processes are deficient in that they do not provide a means of minimizing or substantially eliminating the production of "new", thermal $NO_x$ as final fuel combustion is being completed.

SUMMARY OF THE INVENTION

It is an object of the present invention to provide a novel fuel combustion process whereby, upon completion of combustion, the emission of $NO_x$, particularly thermal $NO_x$, is reduced or substantially eliminated.

Accordingly, in its broadest aspect, the present invention provides a combustion process for nitrogen- or for sulphur- and nitrogen-bearing fuels wherein fuel combustion is divided, by staged oxygen (preferably in the form of air) injection, into at least two combustion zones. The first combustion zone involves providing fuel-rich stoichiometric conditions under which nitrogen chemically bound in the fuel (i.e. fuel-bound nitrogen) is substantially converted to molecular nitrogen. The second (final) combustion zone comprises at least two stages.

In the first stage of the final combustion zone, combustion products from the first combustion zone are further combusted under a condition of fuel-rich stoichiometry, preferably at an oxygen-fuel stoichiometric ratio of from about 0.80 to about 1.0 and at a temperature of less than about 2200 K. In the second stage of the final combustion zone, combustion products from the first stage are combusted at an oxygen/fuel stoichiometric ratio of greater than about 1.0 and at a temperature of less than about 1500 K. In this zone, fuel combustion is completed while formation of new, thermal $NO_x$ is substantially prevented.

It has been discovered that the provision of this two-stage final combustion zone can also provide significant advantages in ultimate $NO_x$ control in many combustion systems. Thus, it is believed that the two-stage final combustion zone of the present invention may also be utilized with many of the prior art $NO_x$ control combustion processes which use a more conventional single stage (excess air) combustion zone as hereinbefore described.

BRIEF DESCRIPTION OF THE DRAWING

Embodiments of the present invention will be described with reference to the attached FIGURE, in which there is illustrated a plot of combustion temperature versus oxygen/fuel stoichiometric ratio, including a number of lines of constant equilibrium $NO_x$.

DETAILED DESCRIPTION OF THE PREFERRED EMBODIMENTS

Figure 1:
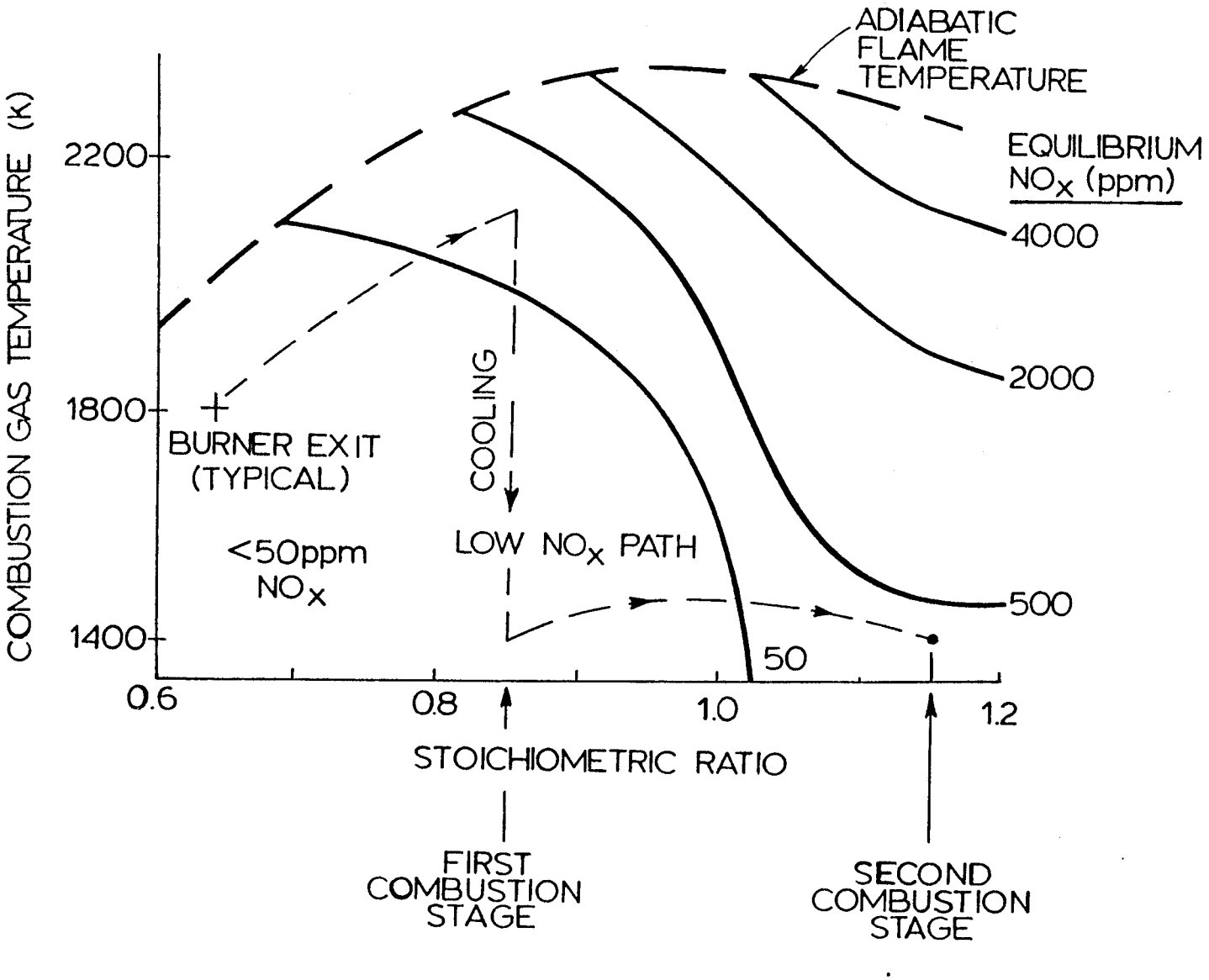

As used throughout this specification the term "fuel-rich combustion products" refers to combustion gases comprising a major concentration of a reduced compound such as one or more of carbon monoxide, hydrogen, $NH_3$, HCN, $H_2S$ and unburned gaseous hydrocarbons, along with more conventional oxides of said compounds. Moreover, the term "fuel-rich stoichiometry" refers to oxygen/fuel stoichiometric ratios less than 1.0.

In a preferred embodiment of the present invention, there is provided a combustion process for a nitrogen-bearing fuel comprising the steps of:

(a) introducing the fuel into a first combustion zone;

(b) combusting the fuel in the first combustion zone under a condition of fuel-rich stoichiometry and at a temperature whereby fuel-rich combustion products are produced and undesirable nitrogenous compounds are reduced to low levels;

(c) passing these fuel-rich combustion products into a two-stage final combustion zone;

(d) combusting the combustion products in the first stage of the final combustion zone under a condition of fuel-rich stoichiometry and at a temperature of less than about 2200 K.; and (e) thereafter, combusting the combustion products from the first stage in the second stage of the final combustion zone at an oxygen/fuel stoichiometric ratio of greater than about 1.0 and at a temperature of less than about 1500 K.

In this embodiment of the present invention, the first combustion zone is essentially a fuel $NO_x$ control zone. It is preferred to add to this first combustion zone a finely dispersed particulate material which enhances conversion of undesirable nitrogenous compounds (e.g. $NO_x$, $NH_3$ and HCN) to harmless molecular nitrogen. Non-limiting examples of suitable particulate materials include calcium sulphide, calcium oxide, iron sulphide, iron oxide and mixtures thereof. The condition of fuel-rich stoichiometry in the first combustion zone preferably comprises an oxygen/fuel stoichiometric ratio of from about 0.45 to about 0.80, more preferably from about 0.55 to about 0.70. The temperature in the first combustion zone is preferably in the range of from about 1500 K. to about 1800 K.

In another embodiment, the present invention provides a combustion process for a sulphur- and nitrogen-bearing fuel comprising the steps of:

(a) introducing the fuel into a first combustion zone;

(b) combusting the fuel in the presence of a sulphur-capture compound in the first combustion zone under a condition of fuel-rich stoichiometry and at a temperature whereby a combustion mixture is produced including fuel-rich gases, solid sulphur-bearing flyash and slag;

(c) passing the combustion mixture to a second combustion zone;

(d) combusting the mixture in the second combustion zone under a condition of fuel-rich stoichiometry and at a temperature whereby fuel-rich combustion products are produced, such that the undesirable nitrogenous compound level in the combustion products is reduced to a low level;

(e) passing the combustion products into a two-stage final combustion zone;

(f) combusting the combustion products in the first stage of the final combustion zone under a condition of fuel-rich stoichiometry and at a temperature of less than about 2200 K.; and (g) thereafter, combusting the combustion products in the second stage of the final combustion zone at an oxygen/fuel stoichiometric ratio greater than about 1.0 and at a temperature of less than about 1500 K.

In this embodiment of the present invention, the first combustion zone is essentially a sulphur capture or $SO_x$ control zone and the second combustion zone is essentially a fuel $NO_x$ control zone. Preferably, the sulphur-capture compound is calcium-based, more preferably the compound is selected from the group comprising oxides, hydroxides and carbonates of calcium. The most preferred sulphur-capture compound is calcium carbonate (limestone).

Preferably, the condition of fuel-rich stoichiometry in the first combustion zone comprises an oxygen/fuel stoichiometric ratio of less than about 0.50, more preferably from about 0.25 to about 0.40. The temperature in the first combustion (i.e. sulphur capture) zone is preferably in the range of from about 1200 K. to about 1600 K. Preferably, the condition of fuel-rich stoichiometry in the second combustion (i.e. fuel $NO_x$ control) zone comprises an oxygen/fuel stoichiometric ratio of from about 0.45 to about 0.80, more preferably from about 0.55 to about 0.70. The temperature in the second combustion zone is preferably in the range of from about 1500 K. to about 1800 K.

For the two embodiments discussed above, it is preferred that the condition of fuel-rich stoichiometry in the first stage of the final combustion zone comprises an oxygen/fuel stoichiometric ratio of from about 0.80 to about 1.0.

In yet another embodiment of the present invention, there is provided a coal combustion process comprising the steps of:

(a) introducing particulate coal into a first combustion zone;

(b) combusting the coal in the presence of a sulphur-capture compound in the first combustion zone at an oxygen/fuel stoichiometric ratio of from about 0.25 to about 0.40 and at a temperature in the range of from about 1200 K. to about 1600 K., whereby a combustion mixture is produced including fuel-rich gases, slag and solid sulphur-bearing flyash entrained in said gases;

(c) passing the combustion mixture to a second combustion zone;

(d) combusting the combustion mixture in said second combustion zone at an oxygen/fuel stoichiometric ratio of from about 0.55 to about 0.70 and at a temperature in the range of from about 1500 K. to about 1800 K., whereby fuel-rich combustion products are produced, such that the level of undesirable nitrogenous compounds in the combustion products is reduced to a low level;

(e) separating the slag and a major portion of the flyash from the combustion products;

(f) passing the remaining combustion products into a two-stage final combustion zone;

(g) combusting the remaining combustion products in the first stage of the final combustion zone at an oxygen/fuel stoichiometric ratio of from about 0.80 to about 1.0 and at a temperature of less than about 2200 K.; and (h) thereafter, combusting the combustion products from the first stage in the second stage of the final combustion zone at an oxygen/fuel stoichiometric ratio of greater than about 1.0 and at a temperature of less than about 1500 K.

It should be appreciated that reference to a particular "oxygen/fuel stoichiometry" as used in this specification also encompasses mixtures of air and fuel where air is used in sufficient quantity such that the amount of oxygen provided by the air meets the particular oxygen/fuel stoichiometry.

Throughout the specification, when reference is made to low levels of nitrogenous compounds in the combustion products entering the final combustion zone, it will be appreciated that this refers to $NO_x$ levels preferably less than about 500 ppm, more preferably less than about 250 ppm and most preferably at about 100 ppm.

Generally, the present invention is suitable for use with conventional combustible fuels. Non-limiting examples of such fuels include coal, lignite, wood, tar and petroleum by-products which are solid at ambient temperatures; mixtures of two or more of these fuels may also be used. The preferred fuel for use with the present process is coal.

Referring now to the Figure, there is illustrated a plot of combustion temperature versus oxygen/fuel stoichiometric ratio, including a number of lines of constant equilibrium $NO_x$. The Figure shows that $NO_x$ levels are very sensitive to both gas temperature and stoichiometric ratio for temperatures less than about 2200 K. and stoichiometric ratios less than about 1.10. For example, at a stoichiometric ratio of 0.85, the gases have to be cooled only about 12% (i.e. from about 2240 K. to about 1990 K.) to reduce equilibrium $NO_x$ levels from about 500 ppm to about 50 ppm.

In the case of combusting a sulphur- and nitrogen-bearing fuel, it is preferred to remove the slag formed and a major portion of the solid sulphur-bearing flyash entrained in the combustion gases present after the second (fuel $NO_x$ control) combustion zone. This may be achieved utilizing a suitable slag/flyash separator. When such a separator is used, approximately 6 percent of the heat of combustion of the fuel is removed from the hot gases by the water cooling circuit in the separator. This corresponds to about a 200 K. cooling from adiabatic of the gases exiting the burner into the final combustion zone (typically in a boiler). Approximately half of the remaining excess oxygen may then be injected into the fuel-rich gases leaving the burner thereby raising the stoichiometric ratio of the gases entering the first stage of the final combustion zone to from about 0.8 to about 1.0. Final combustion conditions in the first stage of this zone will be such that equilibrium $NO_x$ levels are at or near zero. During this stage, under such relatively high temperatures and at nearly stoichiometric mixture ratios, carbon monoxide, hydrogen and any unburned carbon may be substantially burned out with virtually no generation of "new", thermal $NO_x$. Preferably, the first stage of the final combustion zone is provided with heat transfer means to cool the gases to less than 1500 K. before they enter the second stage of the final combustion zone. Final, excess oxygen is then added to facilitate substantially complete fuel burnout in the second stage.

A preferred mode of operating the final two-stage combustion zone of the present invention is shown in the Figure by the dashed line labelled "Low $NO_x$ Path". As illustrated, the first stage of the final combustion zone encompasses an oxygen/fuel stoichiometric ratio of greater than about 0.80 and a temperature of less than about 2200 K. The second stage of the final combustion zone encompasses an oxygen/fuel stoichiometric ratio of greater than about 1.0 and a temperature of less than about 1500 K.

An embodiment of the present invention will now be described with reference to the following Example, which should not be construed as limiting the invention.

A pilot-scale low $NO_x/SO_x$ burner was provided. The burner comprised first combustion (i.e. sulphur capture) and second combustion (i.e. fuel $NO_x$ control) zones. Combustion gases exited the burner at relatively low oxygen/fuel stoichiometric ratios and at relatively high temperatures. All of the final combustion oxygen was injected, in the form of air, into these fuel-rich combustion gases at the burner exit. Final combustion was completed in a simulated boiler section which comprised approximately 5.2 m of externally water-cooled bare steel ducting followed by approximately 4.6 m in the first pass of a commercial waste heat boiler. The combustion gases were cooled in the bare steel ducting section to about 1200 K. The results of the experiments are provided in Table 1. It should be appreciated that Examples 3 and 4 are of a comparative nature only and, thus, are outside the scope of the present invention.

TABLE 1

NOx Growth/Decay in the Final Combustion Zone

| | Stoichiometric Ratio | | NOx, ppm dry at 3% $O_2$: Distance Downstream of the Burner Exit, m | | |
|---|---|---|---|---|---|
| Example | (1) | (2) | 0 | 3.7 | 9.8 |
| 1 | 0.47 | 0.91 | 226 | 134 | 86 |
| 2 | 0.46 | 0.91 | 157 | — | 68 |
| 3 | 0.78 | 1.31 | 119 | 195 | 183 |
| 4 | 0.59 | 1.26 | 54 | 143 | 132 |

(1) Second combustion zone (burner exit)
(2) First stage of final combustion zone (simulated boiler)

As shown in Table 1, Examples 1 and 2 illustrate a process operated in accordance with the present invention. In each of these Examples, the oxygen/fuel stoichiometric ratio in the second (fuel $NO_x$ control) combustion zone was less than 0.5 and that in the first stage of the final combustion zone was in the preferred range of from 0.8 to 1.0. By contrast, in Examples 3 and 4, combustion in the first stage of the final combustion zone was conducted at an oxygen/fuel stoichiometric ratio of 1.26 and 1.31, respectively.

The concentration of fuel $NO_x$ at the burner exit was relatively low for each Example (i.e. from 54 to 226 ppm). When the first stage of the final combustion zone was operated fuel-rich (i.e. 0.91 for each of Examples 1 and 2), not only was there no additional (i.e. thermal) $NO_x$ formed, the total concentration of $NO_x$ (i.e. fuel and thermal) was reduced further. In contrast, when the first stage of the final combustion zone was operated oxygen-rich (Examples 3 and 4), additional, thermal $NO_x$ was formed. In the case of Example 4, the concentration of $NO_x$ in the boiler nearly tripled from that exiting the burner.

What is claimed is:

1. A combustion process for a nitrogen-bearing solid fuel comprising the steps of:

(a) introducing said fuel into a first combustion zone;

(b) combusting said fuel in said first combustion zone under a condition of fuel-rich stoichiometry at an oxygen to fuel stoichiometric ratio of from 0.45 to 0.80 and at a temperature in the range of from 1500 K. to 1800 K. whereby fuel-rich combustion products are produced and undesirable nitrogenous compounds are reduced to low levels;

(c) passing said fuel-rich combustion products into a two-stage final combustion zone;

(d) combusting said fuel-rich combustion products in the first stage of said final combustion zone under a condition of fuel-rich stoichiometry at an oxygen to fuel stoichiometric ratio of from 0.80 to 1.0 and at a temperature in the range of from 1500 K. to 2200 K. to produce combustion products having nitrogenous oxide levels reduced substantially to near zero while substantially burning out combustibles virtually free from generation of any additional thermal nitrogenous oxides; and (e) thereafter, combusting said combustion products in the second stage of said final combustion zone at an oxygen to fuel stoichiometric ratio of greater than 1.0 and at a temperature of less than 1500 K. to facilitate substantially complete fuel burnout in the second stage of said final combustion zone.

2. The process defined in claim 1, wherein to said first combustion zone is added a finely dispersed particulate material which enhances conversion of undesirable nitrogenous compounds to molecular nitrogen.

3. The process defined in claim 2, wherein said particulate material is selected from the group comprising calcium sulphide, calcium oxide, iron sulphide, iron oxide and mixtures thereof.

4. The process defined in claim 1, wherein the condition of fuel-rich stoichiometry in said first combustion zone comprises an oxygen/fuel stoichiometric ratio of from 0.55 to 0.70.

5. A combustion process for a sulphur- and nitrogen-bearing solid fuel comprising the steps of:

(a) introducing said fuel into a first combustion zone;

(b) combusting said fuel in the presence of a sulphur-capture compound in said first combustion zone under a condition of fuel-rich stoichiometry and at a temperature whereby a combustion mixture is produced including fuel-rich gases, solid sulphur-bearing flyash and slag;

(c) passing said combustion mixture to a second combustion zone;

(d) combusting said combustion mixture in said second combustion zone under a condition of fuel-rich stoichiometry at an oxygen to fuel stoichiometric ratio of from 0.45 to 0.80 and at a temperature in the range of from 1500 K. to 1800 K. whereby fuel-rich combustion products are produced and undesirable nitrogenous compounds are reduced to a low level;

(e) passing said fuel-rich combustion products into a two-stage final combustion zone;

(f) combusting said fuel-rich combustion products in the first stage of said final combustion zone under a condition of fuel-rich stoichiometry at an oxygen to fuel stoichiometric ratio of from 0.80 to 1.0 and at a temperature in the range of from 1500 K. to 2200 K. to produce combustion products having nitrogenous oxide levels reduced substantially to near zero while substantially burning out combustibles virtually free from generation of any additional thermal nitrogenous oxides; and (g) thereafter, combusting said combustion products in the second stage of said final combustion zone at an oxygen to fuel stoichiometric ratio of greater than 1.0 and at a temperature of less than 1500 K. to facilitate substantially complete fuel burnout in the second stage of said final combustion zone.

6. The process defined in claim 5, wherein the condition of fuel-rich stoichiometry in said first combustion zone comprises an oxygen/fuel stoichiometric ratio of less than about 0.50.

7. The process defined in claim 5, wherein the condition of fuel-rich stoichiometry in said first combustion zone comprises an oxygen/fuel stoichiometric ratio of from about 0.25 to about 0.40.

8. The process defined in claim 7, wherein the condition of fuel-rich stoichiometry in said second combustion zone comprises an oxygen/fuel stoichiometric ratio of from 0.55 to 0.70.

9. The process defined in claim 7, wherein the temperature in said first combustion zone is in the range of from 1200 K. to 1600 K.

10. The process defined in claim 5, wherein said sulphur-capture compound is selected from the group comprising oxides, hydroxides and carbonates of calcium, and combinations thereof.

11. The process defined in claim 1 or claim 5, wherein said fuel is selected from the group comprising coal, lignite, wood, tar and petroleum products and by-products.

12. The process defined in claim 1 or claim 5, wherein said fuel is coal.

13. A coal combustion process comprising the steps of:

(a) introducing particulate coal into a first combustion zone;

(b) combusting said coal in the presence of a sulphur-capture compound in said first combustion zone at an oxygen to fuel stoichiometric ratio of from 0.25 to 0.40 and at a temperature in the range of from 1200 K. to 1600 K., whereby a combustion mixture is produced including fuel-rich gases, slag, and solid sulphur-bearing flyash entrained in said gases;

(c) passing the combustion mixture to a second combustion zone;

(d) combusting said combustion mixture in said second combustion zone at an oxygen to fuel stoichiometric ratio of from 0.55 to 0.70 and at a temperature in the range of from 1500 K. to 1800 K., whereby fuel-rich combustion products are produced, such that the level of undesirable nitrogenous compounds in said combustion products is reduced to a low level;

(e) separating said slag and a major portion of said flyash from the combustion products;

(f) passing the remaining combustion products into a two-stage final combustion zone;

(g) combusting said remaining combustion products in the first stage of said final combustion zone at an oxygen to fuel stoichiometric ratio of from 0.80 to 1.0 and at a temperature in the range of from 1500 K. to 2200 K. to produce combustion products having nitrogenous oxide levels reduced substantially to near zero while substantially burning out combustibles virtually free from generation of any additional thermal nitrogenous oxides; and (h) thereafter, combusting the combustion products from said first stage in the second stage of said final combustion zone at an oxygen to fuel stoichiometric ratio of greater than 1.0 and at a temperature of less than 1500 K. to facilitate substantially complete fuel burnout in the second stage of said final combustion zone.

* * * * *

UNITED STATES PATENT AND TRADEMARK OFFICE

CERTIFICATE OF CORRECTION

PATENT NO. : 5,085,156

DATED : February 4, 1992

INVENTOR(S) : OWEN W. DYKEMA

It is certified that error appears in the above-identified patent and that said Letters Patent is hereby corrected as shown below:

Title Page:

IN [57] ABSTRACT

Line 12, "conbusted" should read --combusted--.
Line 14, "0.08" should read --0.80--.

COLUMN 1

Line 22, "deal" should read --deal of--.
Line 46, "processing" should read --processes--.

COLUMN 6

Line 32, "1.26 and 1.31," should read --1.31 and 1.26,--.

Signed and Sealed this

Sixth Day of July, 1993

Attest:

Michael K. Kirk

MICHAEL K. KIRK

Attesting Officer

Acting Commissioner of Patents and Trademarks